United States Patent [19]

Yéou

[11] 4,376,612

[45] Mar. 15, 1983

[54] EARTHWORKING MACHINE OF THE LOADER TYPE

[75] Inventor: Victor Yéou, Meaux, France

[73] Assignee: Poclain, Le Plessis-Belleville, France

[21] Appl. No.: 263,097

[22] Filed: May 12, 1981

[30] Foreign Application Priority Data

May 28, 1980 [FR] France ..... 80 11825
Apr. 7, 1981 [FR] France ..... 81 06981

[51] Int. Cl.[3] ..... E02F 3/42; E02F 9/22

[52] U.S. Cl. ..... 414/694; 414/708; 91/33

[58] Field of Search ..... 414/694, 706, 699, 700, 414/708; 37/103, DIG. 7, DIG. 9; 91/32, 33, 520, 531; 60/484, 486

[56] References Cited

U.S. PATENT DOCUMENTS 3,966,066 6/1976 Schexnayder ..... 414/706
4,179,981 12/1979 Yeou ..... 91/33

FOREIGN PATENT DOCUMENTS 1326534 4/1963 France .
2197092 3/1974 France .
2329881 5/1977 France .
2357764 2/1978 France .
2415600 8/1979 France .
1224948 3/1971 United Kingdom .

OTHER PUBLICATIONS

European Patent Application No. 0 004 839, Lundström, 1979.

*Primary Examiner*—Robert J. Spar
*Assistant Examiner*—Terrance L. Siemens
*Attorney, Agent, or Firm*—Mason, Fenwick & Lawrence

[57] ABSTRACT

The invention relates to a hydraulic loader comprising a boom, a balance beam and a bucket for loading material, boom jacks and balance beam jacks being coupled between the frame and the boom and between the boom and the balance beam. A secondary jack is also coupled between the frame and the boom and comprises an active chamber, while a first conduit connects this active chamber to the extension chamber of the balance beam jack and a first cut-off valve is disposed in this first conduit, establishing, in its first position, communication of the two sections of the first conduit which are connected thereto, isolating, on the contrary, in its second position, these two sections. One application of the invention is the production of a powerful and efficient loader.

13 Claims, 7 Drawing Figures

H
26
TB3
TB3'
TR3
TR3'
TF2
TF3
V
TR2
100
TB2
8
9
18
13
27
14
28
11
10
3
6
17
16
12
15
20
21
23
7
25
19
24
22
1
5
4
2

80
78
112
79
96
111
109
108
110
108
89
16
14
28
13
18
90
12
19
77
59
57
88
27
17
15
24
56
77
114
60
61
58
96
85
85
86
113
45
41
95
37
97
87
43
39
35
30
55
54
53
62
34
52
31
42
40
92
38
91
36
44
64
63
66
67
65
99
93
46
50
51
48
49
94
47
73
75
76
74
72
74
71
68
70
75
33
32
69
98
29

EARTHWORKING MACHINE OF THE LOADER TYPE

The present invention relates to an earthworking machine of the loader type.

Hydraulic loaders are already known which are provided with a boom, a balance beam and a bucket. The desired displacement of the bucket is of two distinct types, one corresponding to the loading phase of the bucket, the other to the lifting phase of the bucket. In one case, the movement of penetration of the bucket in the material must be horizontal, in the other case, this movement must be vertical.

Despite designs which are often complicated, there are very few loaders which enable this basic mode of functioning to be obtained.

It is an object of the invention to propose a novel hydraulic loader of simple design, whose elaborate hydraulic control circuit enables not only the desired basic functioning to be obtained but also other advantages which will be apparent hereinafter.

The invention therefore relates to an earthworking machine of the loader type, constituted by:

a frame, a boom mounted to pivot with respect to the frame about a first axis, a balance beam mounted to pivot with respect to the boom about a second axis, the first and second axes being parallel to each other, a material loading bucket coupled to the balance beam, preferably by means of a third pivot axis and a bucket jack, a double-acting, boom jack, coupled between the frame and the boom and comprising a boom raising chamber and a boom lowering chamber, a double-acting, balance beam jack, coupled between the boom and the balance beam and comprising a chamber for extension of the balance beam with respect to the boom and a chamber for return of the balance beam with respect to this boom, a circuit for supplying said jacks with pressurised fluid comprising:

at least one source of pressurised fluid, and at least two three-way control valves disposed as follows: a boom control valve between the boom jack and a source of fluid under pressure and, a balance beam control valve between the balance beam jack and a source of fluid under pressure, each capable of selectively placing one of the chambers of the corresponding jack in communication with the source of fluid under pressure, with an exhaust or of isolating this chamber from said source of fluid under pressure and, correlatively, of placing the other chamber in communication with the exhaust, with the source of pressurised fluid, or of isolating this other chamber from said source of pressurised fluid, and a secondary jack coupled between the frame and the boom and comprising at least one active chamber.

A first conduit connects this active chamber of the secondary jack to the chamber for extension of the balance beam jack and a first cut-off valve with at least two positions is disposed in this first conduit, establishing, in its first position, the communication of the two sections of the first conduit connected thereto, but isolating, in its second position, these two sections.

The following arrangements are also advantageously preferably adopted:

a second conduit connects the lowering chamber of the boom jack and the return chamber of the balance beam jack, whilst a second cut-off valve with at least two positions is disposed in this second conduit, establishing, in its first position, the communication of the two sections of the second conduit which are connected thereto, but isolating, in its second position, these two sections, and a synchronisation device ensures the concomitance of the positioning of the first and second cut-off valves in their respective first position and in their respective second position;

a third conduit connects the raising chamber of the boom jack and the active chamber of the secondary jack, whilst a third cut-off valve with at least two positions is disposed in this third conduit, isolating, in its first position, the two sections of the third conduit connected thereto, but establishing, in its second position, communication of these two sections, the synchronisation device further ensuring the concomitance of the positioning of the first and third cut-off valves in their respective first position and in their respective second position;

the first and third cut-off valves constitute a single main cut-off valve, whilst the sections of the first conduit and of the third conduit connected to the active chamber of the secondary jack constitute a single, connecting conduit, connecting said active chamber to said main cut-off valve, this main cut-off valve having two positions and, in its first position, establishing communication of the section of the first conduit connected to the extension chamber of the balance beam jack and of the connecting conduit and obturating the section of the third conduit connected to the raising chamber of the boom jack, establishing, on the contrary, in its second position, communication of the second of the third conduit connected to said raising chamber and of the connecting conduit, then obturating said section of the first conduit connected to the extension chamber;

the circuit for supplying the boom and balance beam jacks is of the series-supply circuit type, and in particular comprises a single source of fluid under pressure connected to the boom control valve, a fourth conduit which connects this boom control valve to the raising chamber of the boom jack, a fifth conduit which connects the boom control valve to the balance beam control valve and a sixth conduit which connects the balance beam control valve to the extension chamber of the balance beam jack, whilst the synchronisation device ensures concomitance of the positioning of the balance beam control valve in the position connecting the fifth conduit which then ensures exhaust of the raising chamber of the boom jack, to the sixth conduit which ensures the communication of the extension chamber of the balance beam jack with a source of fluid under pressure and of the third cut-off valve, or of the main cut-off valve, in its second position;

a seventh conduit connects the lowering and raising chambers of the boom jack, whilst a non-return valve is disposed in this seventh conduit and allows passage of the fluid solely from the lowering chamber towards the raising chamber;

when the machine does not comprise the second cut-off valve mentioned above and, furthermore, a bucket jack is coupled between the balance beam and the bucket, said jack being of the double-acting type and comprising a bucket filling chamber and a bucket emptying chamber, it is advantageous if an eighth conduit connects the filling chamber of the bucket jack to the return chamber of the balance beam jack, a fourth cut-off valve having at least two positions being disposed in this eighth conduit, establishing, in its first position, communication of the two sections of the eighth conduit which are connected thereto and on the contrary isolating these two sections, in its second position;

the machine comprises, in this latter case, a synchronisation device which ensures concomitance of the positioning of the first and fourth cut-off valves in their respective first position and in their respective second position; and the supply circuit of the boom jack comprising in particular a source of fluid under pressure connected to the boom control valve and a fourth conduit which connects this boom control valve to the raising chamber of the boom jack, said synchronisation device then ensures the concomitance of the positioning of the boom control valve in its position in which the fourth conduit is connected to the source of fluid under pressure, and of the positioning of the fourth cut-off valve in its first position.

The invention will be more readily understood on reading the following description with reference to the accompanying drawings, in which.

Figure 1:
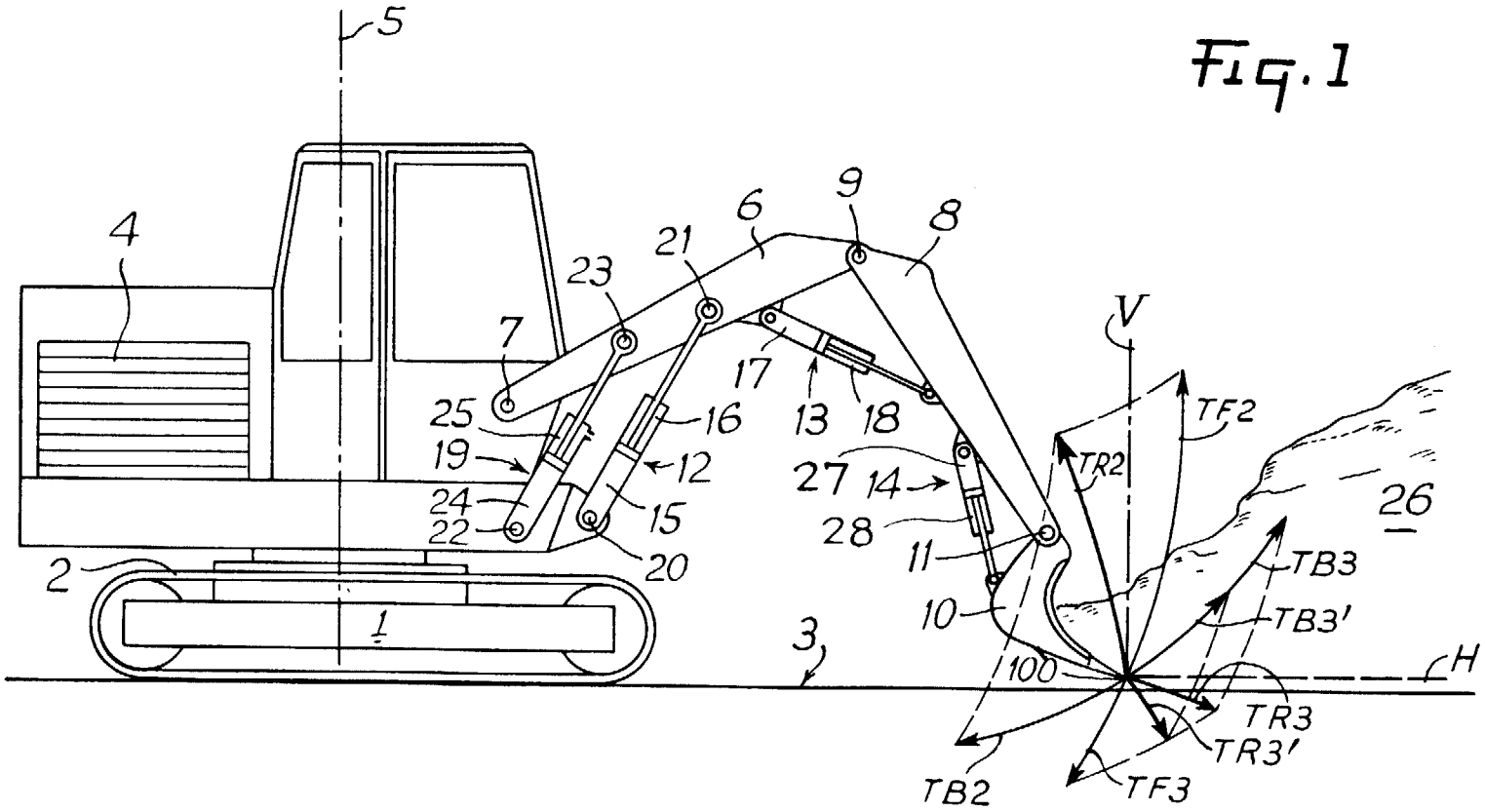
FIG. 1 is a view in elevation of a machine according to the invention.

Referring now to the drawings, the loader shown in FIG. 1 comprises a chassis 1, provided with endless tracks 2 by means of which it abuts on the ground 3. A turret 4 is mounted to pivot on the chassis 1 about a vertical axis 5. A boom 6 is pivoted on the turret 4 about a horizontal axis 7, whilst a balance beam 8 is itself pivoted on the boom 6 about an axis 9 parallel to axis 7, and a bucket 10 is pivoted on the balance beam 8 about an axis 11 parallel to axis 7. A main boom jack 12 is coupled between the turret 4 and the boom 6, a balance beam jack 13 being coupled between the boom 6 and the balance beam 8 and a bucket jack 14 being coupled between the balance beam 8 and the bucket 10. In addition, a secondary jack 19 is also coupled between the turret 4 and the boom 6, the pivot pins 20 and 21 of the boom jack 12 being distinct from the pivot pins 22 and 23 of the secondary jack.

The chambers of the jacks 12, 13 and 19 should be distinguished, and it should be noted that the supply of the large chamber 15 of the jack 12 corresponds to the raising of the boom 6, the supply of the small chamber 16 of said jack corresponding, on the contrary, to the lowering of the boom 6; similarly, the supply of the large chamber 17 of the jack 13 corresponds to the extension of the balance beam 8 with respect to the boom 6, the supply of the small chamber 18 of the jack 13 corresponding, on the contrary, to the return of the balance beam 8 under the boom 6. Finally, the large chamber 24 of the secondary jack 19 fills with fluid when the large chamber 15 of the jack 12 is supplied with fluid. This is the only active chamber of the secondary jack 19, the other chamber 25 of this jack being connected to atmosphere (or to a discharge tank without pressure). The chambers 15 and 16 of the boom jack 12 are designated as chambers for raising and lowering this jack, respectively, the chambers 17 and 18 of the balance beam jack 13 being called extension and return chambers, respectively. In the configuration of FIG. 1, the bucket 10 is in the course of penetrating in a pile of material 26. Finally, the bucket jack 14 comprises a large chamber 27, called bucket filling chamber, and a small chamber 28, called bucket emptying chamber.

Figure 2:
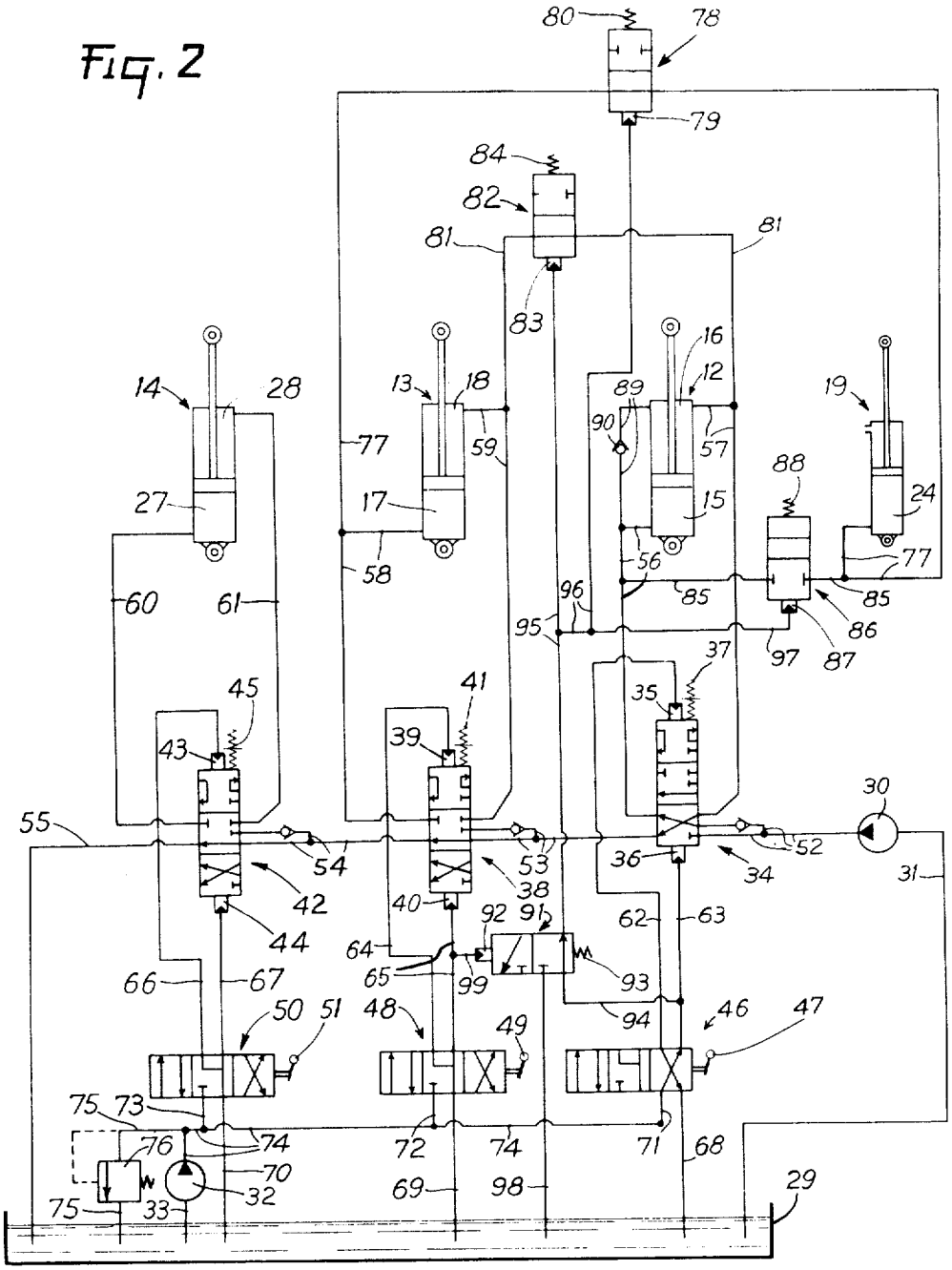
FIGS. 2, 3 and 4 show the diagram of the hydraulic control circuit of the machine of FIG. 1, in three distinct configurations of functioning.
Figure 3:
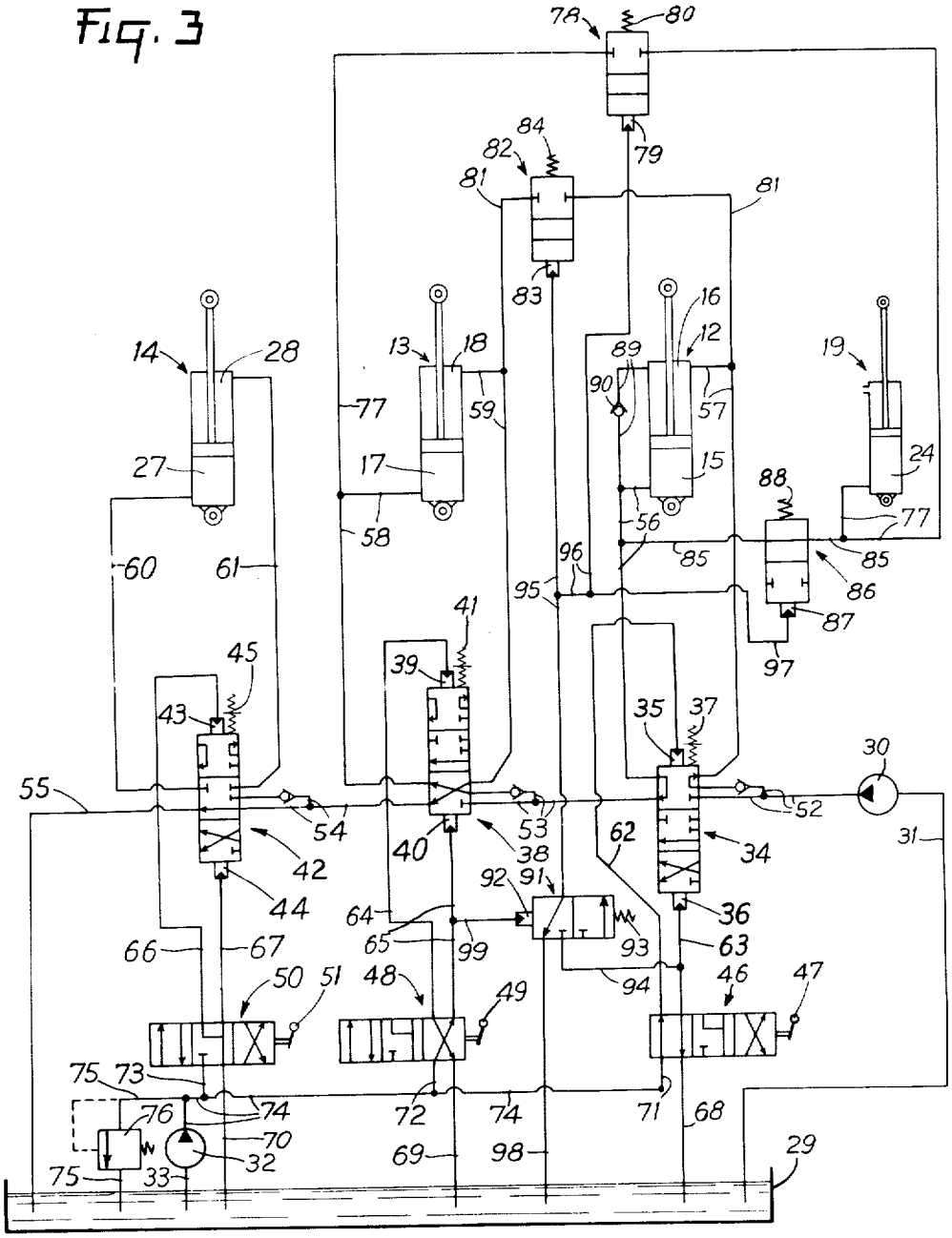
Figure 4:
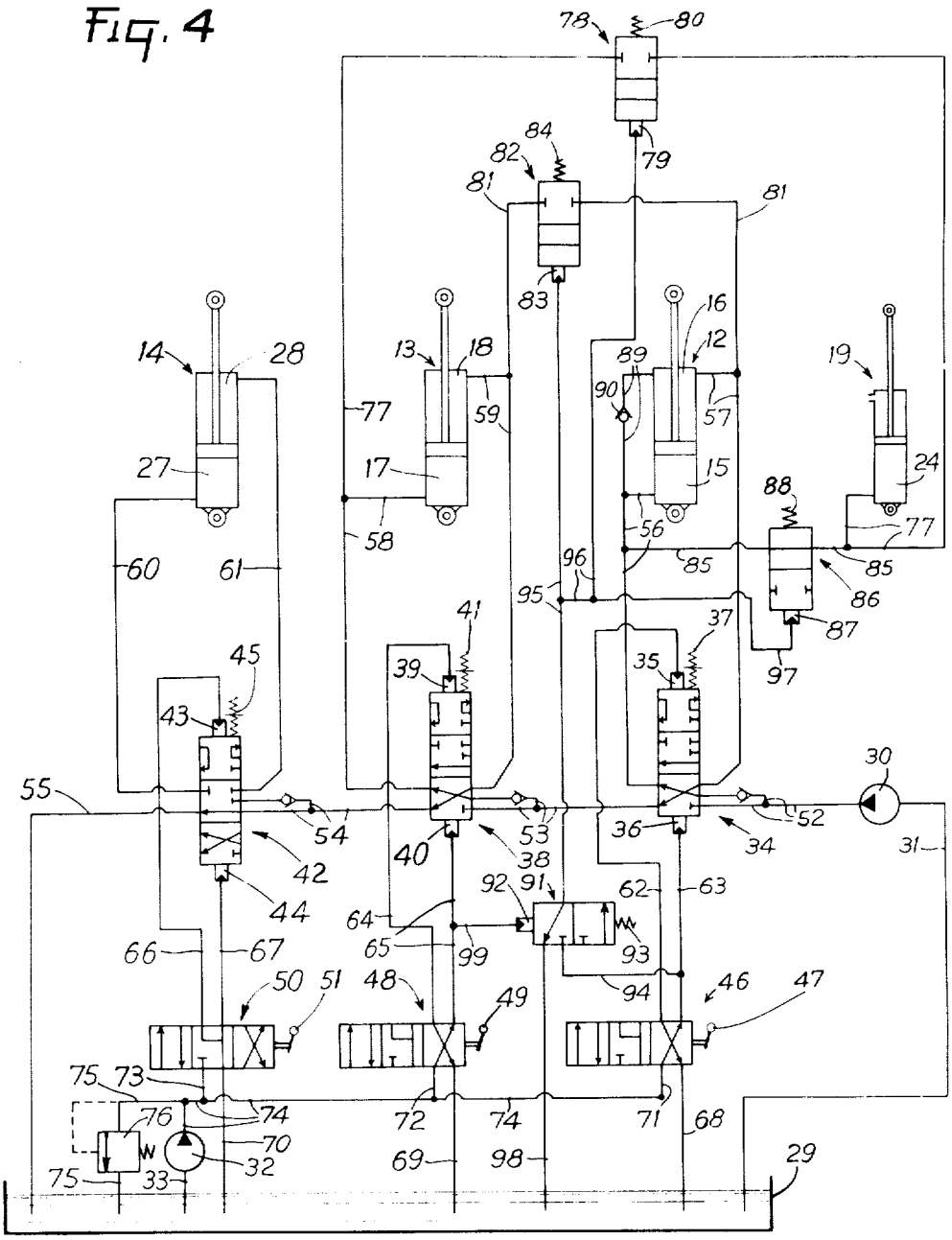

The control circuit of this machine, shown in FIGS. 2, 3 and 4, comprises:

a fluid tank 29, a main pump 30 connected to the tank 29 via its suction conduit 31, a drive pump 32 connected to a tank 29 via its suction conduit 33, a three-way boom control valve 34 provided with jacks 35 and 36 for adjustment of position, placing it in its first and third positions, respectively, when they are supplied with drive fluid, and with a return spring 37 returning it into its second position when neither of the jacks 35 and 36 is supplied, a three-way balance beam control valve 38 provided with jacks 39 and 40 for adjustment of position, placing it in its first and third positions, respectively, when they are supplied with drive fluid, and with a return spring 41 returning it into its second position when neither of the jacks 39 and 40 is supplied, a three-way bucket control valve 42 provided with jacks 43 and 44 for adjustment of position, placing it in its first and third positions, respectively, when they are supplied with drive fluid, and with a return spring 45, returning it into its second position when neither of the jacks 43 and 44 is supplied, a control valve 46 for controlling the selective supply of the jacks 35 and 36 of the boom control valve 34, likewise three-way, provided with a voluntary control, such as lever 47 and of which the first, second and third positions correspond respectively to the first, second and third positions of the boom control valve 34, a control valve 48 for controlling the selective supply of jacks 39 and 40 of the balance beam control valve 38, likewise three-way, provided with a voluntary control, such as lever 49, and of which the first, second and third positions correspond, respectively to the first, second and third positions of the balance beam control valve 38, a control valve 50 for controlling the selective supply of the jacks 43 and 44 of the bucket control valve 42, likewise three-way, provided with a voluntary control such as lever 51, and of which the first, second and third positions correspond, respectively, to the first, second and third positions of the bucket control valve 42, the delivery conduit 52 of the main pump 30 connected to the boom control valve 34, a conduit 53 connecting the boom control valve 34 and the balance beam control valve 38, a conduit 54 connecting the balance beam control valve 38 and the bucket control valve 42, a conduit 55 connecting the bucket control valve 42 to the tank 29, conduits 56 and 57 connecting the boom control valve 34 respectively to the raising chamber 15 and lowering chamber 16 of the boom jack 12, conduits 58 and 59 connecting the balance beam control valve 38 respectively to the extension chamber 17 and return chamber 18 of the balance beam jack 13, conduits 60 and 61 connecting the bucket control valve 42 respectively to the large chamber 27 and small chamber 28 of the bucket jack, conduits 62 and 63 connecting the jacks 35 and 36 to the control valve 46, respectively, conduits 64 and 65 connecting the jacks 39 and 40 to the control valve 48, respectively, conduits 66 and 67 connecting the jacks 43 and 44 to the control valve 50, respectively, conduits 68, 69 and 70 connecting the control valves 46, 48 and 50, respectively, to tank 29, conduits 71, 72 an 73 connecting the control valves 46, 48 and 50 respectively, to the delivery conduit 74 of the drive pump 32, a discharge conduit 75 connecting this delivery conduit 74 to the said tank 29, a calibrated discharge valve 76 disposed in the discharge conduit 75 and allowing the excess fluid contained in the delivery conduit 74 to return to tank 29, a conduit 77, which connects the active chamber 24 of the secondary jack 19 to the conduit 58, a first cut-off valve 78, with two positions, which is disposed in the conduit 77 and is provided with a jack 79 for adjusting its position, placing it in its first position when it is supplied with fluid, and with a return spring 80, which on the contrary returns it into its second position when the jack 79 is not supplied, a conduit 81 which connects the conduit 57 to the conduit 59, a second cut-off valve 82, with two positions, which is disposed in the conduit 81 and is provided with a jack 83 for adjusting its position, placing it in its first position when it is supplied with fluid, and with a return spring 84 which, on the contrary, returns it into its second position when the jack 83 is not supplied, a conduit 85 which connects the conduit 56 to conduit 77 (between the active chamber 24 and the first cut-off valve 78), a third cut-off valve 86, with two positions, which is disposed in the conduit 85 and is provided with a jack 87 for adjusting its position, placing it in its first position when it is supplied with fluid, and with a return spring 88, which returns it, on the contrary, into its second position when the jack 87 is not supplied, a conduit 89 which connects the lowering chamber 16 of the boom jack 12 to the conduit 56 connected to the raising chamber 15 of said jack, a non-return valve 90, disposed in this conduit 89 and allowing passage of the fluid solely from the lowering chamber 16 towards the conduit 56 (and therefore towards the raising chamber 15), a two-way control valve 91 provided with a jack 92 for adjusting its position and with a return spring 93, the supply of the jack with pressurised fluid corresponding to the placing of this control valve in its second position, the non-supply of said jack allowing, on the contrary, the spring 93 to return the control valve 91 into its first position, a conduit 94 connecting the control valve 91 to conduit 63 a conduit 95 connecting the control valve 91 to jack 83, a conduit 96 connecting the jack 79 to conduit 95, a conduit 97 connecting the jack 87 to conduit 96, a conduit 98 connecting the control valve 91 to the discharge tank 29, and a conduit 99 connecting the jack 92 to conduit 65.

The positions of the various control valves and cut-off valves now remain to be defined.

The three positions of the control valve 46 correspond as follows:

the first position, to the communication of conduits 71 and 62, and of conduits 63 and 68, the second position, to the communication of conduits 62, 63 and 68, and to the obturation of conduit 71, and the third position to the communication of conduits 71 and 63 and of conduits 62 and 68.

The three positions of the boom control valve 34 correspond as follows:

the first position to the communication of conduits 56 and 53 and of conduits 52 and 57, the second position to the communication of conduits 52 and 53 and to the obturation of conduits 56 and 77, and the third position to the communication of conduits 52 and 56 and of conduits 57 and 53.

The three positions of the control valve 48 correspond as follows:

the first position to the communication of conduits 72 and 64 and of conduits 65 and 69, the second position to the communication of conduits 64, 65 and 69 and to the obturation of conduit 72, and the third position of the communication of conduits 72 and 65 and of conduits 64 and 69.

The three positions of the balance beam control valve 38 correspond as follows:

the first position to the communication of conduits 58 and 54 and of conduits 53 and 59, the second position to the communication of conduits 53 and 54 and to the obturation of conduits 58 and 59, and the third position to the communication of conduits 53 and 58 and of conduits 59 and 54.

The three positions of the control valve 50 correspond as follows:

the first position to the communication of conduits 73 and 66 and of conduits 67 and 70, the second position to the communication of conduits 66, 67 and 70 and to the obturation of conduit 73 and the third position to the communication of conduits 73 and 67 and of conduits 66 and 70.

The three positions of the bucket control valve 42 correspond as follows:

the first position to the communication of conduits 60 and 55, and of conduits 54 and 61, the second position to the communication of conduits 54 and 55 and to the obturation of conduits 60 and 61, and the third position to the communication of conduits 61 and 55 and of conduits 54 and 60.

The two positions of the cut-off valve 78 correspond as follows: the first position to maintaining the continuity of conduit 77 and the second position to the obturation of this conduit 77.

The two positions of the cut-off valve 82 correspond as follows: the first position to maintaining the continuity of conduit 81 and the second position to the obturation of this conduit 81.

The two positions of the cut-off valve 86 correspond as follows: the first position to the obturation of conduit 85 and the second position to maintaining the continuity of this conduit 85.

Finally, the two positions of the control valve 91 correspond as follows: the first position to the communication of conduits 94 and 95 and to the obturation of conduit 98 and the second position to the communication of conduits 95 and 98, and to the obturation of conduit 94.

The three particularly interesting configurations of functioning to be studied have been shown in FIGS. 2, 3 and 4. None of the corresponding functionings describes the movement of the bucket, which is, moreover known, and therefore none concerns the control valves 42 and 50 which, in the three Figures, are placed in their respective second positions. These three particular functionings will now be described separately. Functioning according to the configuration of FIG. 2.

The control valves 34 and 46 are placed in their third position corresponding to the supply of pressurised fluid delivered by the main pump 30 of the raising chamber 15 of the boom jack 12. The control valves 38 and 48 are placed in their second position, so that the fluid of the lowering chamber 16 may return to the tank via conduit 57, control valve 34, conduit 53, control valve 38, conduit 54, control valve 42 and conduit 55. Furthermore, the conduit 65 communicating with the tank 29 via control valve 48 and conduit 69, the spring 93 has placed control valve 91 in its first position. The pressurised fluid contained in the conduit 63 arrives in jacks 79, 83 and 87, via conduits 94, 95, 96 and 97 and the control valve 91, and places the cut-off valves 78, 82 and 86 in their respective first position. These valves place in communication the valve 78, the active chamber 24 of the secondary jack 19 and extension chamber 17 of the balance beam jack 13, and the valve 82, the lowering chamber 16 of the boom jack 12 and return chamber 18 of the balance beam jack 13.

Thus, whilst the supply of pressurised fluid of the raising chamber 15 provokes the rise of the boom 6, the extension of the secondary jack 19 provokes the suction into the active chamber 24 of the fluid contained in the extension chamber 17 and consequently the return of the balance beam 8 towards the boom 6. The resultant path TR2 of the blade 100 of the bucket results from the vector composition of the main displacement due to the rise of the boom TF2 and of the withdrawing displacement due to the return of the balance beam TB2. As shown in FIG. 1, TR2 is a path slightly disengaged with respect to the vertical V, which is sought at the moment of elevation of the bucket 10 after it has been loaded with material 26.

It should further be noted that, if need be, the fluid contained in the lowering chamber 16 of the boom jack 12 may complete that of the return chamber 18 of the balance beam jack 13 and, by feeding this chamber 18, avoid any risk of cavitation. Functioning according to the configuration of FIG. 3.

The control valves 34 and 46 are placed in their respective first position, corresponding to the supply of pressurised fluid delivered by the main pump 30 of the lowering chamber 16 of the boom jack 12 and to the delivery of the fluid contained in the raising chamber 15 in the conduit 53. The distributors 38 and 48 are both placed in their respective third position corresponding to the placing of conduit 53 in communication with conduit 58 and consequently to the supply of the extension chamber 17 of the balance beam jack 13 by the fluid delivered in the conduit 53. The fluid delivered from the return chamber 18 returns to the tank 29 via conduits 59, 54 and 55. Thus, the lowering of the boom 6 and the extension of the balance beam 8 are controlled simultaneously. This is the phase of penetration of the blade 100 of the bucket in the pile of material 26.

It should be noted that, due to the positioning of the control valve 48 in its third position, the drive fluid delivered in the conduits 65 and 99 places the control valve 91 in its second position. The jacks 79, 83 and 87 of the three cut-off valves are placed in communication with the tank, and these cut-off valves 78, 82 and 86 are replaced, by their respective springs 80, 84 and 88, in their respective second position. In particular, the third cut-off valve 86 places the active chamber 24 in communication only with the raising chamber 15, so that, in conduit 53, the fluid delivered in the conduit 85 from the active chamber 24 is added to the fluid delivered in the conduit 56 from the raising chamber 15. If the secondary jack 19 had not been provided, the resultant displacement of the blade 100 would have had value TR3', composed by the displacements corresponding to the lowering of the boom (TF3) and to the displacement of the balance beam TB3'. Due to the presence of the secondary jack 19, the displacement corresponding to the displacement of the balance beam 8 (and to the displacement TF3 provoked by the lowering of the boom 6) is equal to TB3 and is greater than TB3', so that TR3 is greater than TR3' and is closer to the horizontal H than TR3'. In brief, the penetration is more effective as much because the effort is greater as because it is closer to the horizontal H and therefore the ideal direction of penetration. There again, the functioning obtained is better than that of prior known machines.

It may also be noted, in the functioning described, that the fluid delivered in the conduit 53 is that expelled from the active chamber 24 and raising chamber 15, but is sometimes completed by that supplying the lowering chamber 16, when the pressure in this lowering chamber 16 becomes higher than the pressure in the raising chamber 15, allowing the transfer of fluid from one chamber towards the other through the non-return valve 90, functioning according to the configuration of FIG. 4.

Finally, the operator may wish to control both the raising of the boom and the extension of the beam in order not only to raise the bucket, but also to effect a complete manoeuvre for raising all the operating attachments—boom, balance beam, bucket. In this case, the configuration chosen is that of FIG. 4, in which the control valves 34, 46, 38 and 48 are placed in their respective third position. The pressurised fluid delivered by the pump 30 reaches the raising chamber 15 of the boom jack via conduits 52 and 56, whilst the fluid delivered from the lowering chamber 16 is directed, via conduits 57, 53 and 58, towards the extension chamber 17 of the balance beam jack 13. This is normal functioning of a series-type control valve.

On the contrary, what constitutes a novel, advantageous functioning is the fact that the effort for raising the boom 6 is furnished by the pressurised fluid delivered by the pump 30, which supplies not only the raising chamber 15 of the boom jack 12, but also the active chamber 24 of the secondary jack 19. In fact, as in the preceding configuration of FIG. 3, the three cut-off valves are placed in their respective second position, which has for its effect to place said active chamber 24 solely in communication with the raising chamber 15. Thus, the effort for raising the boom 6, according to the proposed design, is greater than what it was in the previously known machines.

Finally, for each of the three modes of functioning which have just been studied, an improvement is observed in relation with the presence of the secondary jack 19 and of one or more cut-off valves 78, 82, 86.

Naturally, the automatic selections of position of these cut-off valves, obtained by the control valve 91 and the position adjusting jacks 79, 83 and 87 makes this secondary jack 19 easily usable and maximum profit may be drawn therefrom.

Figure 5:
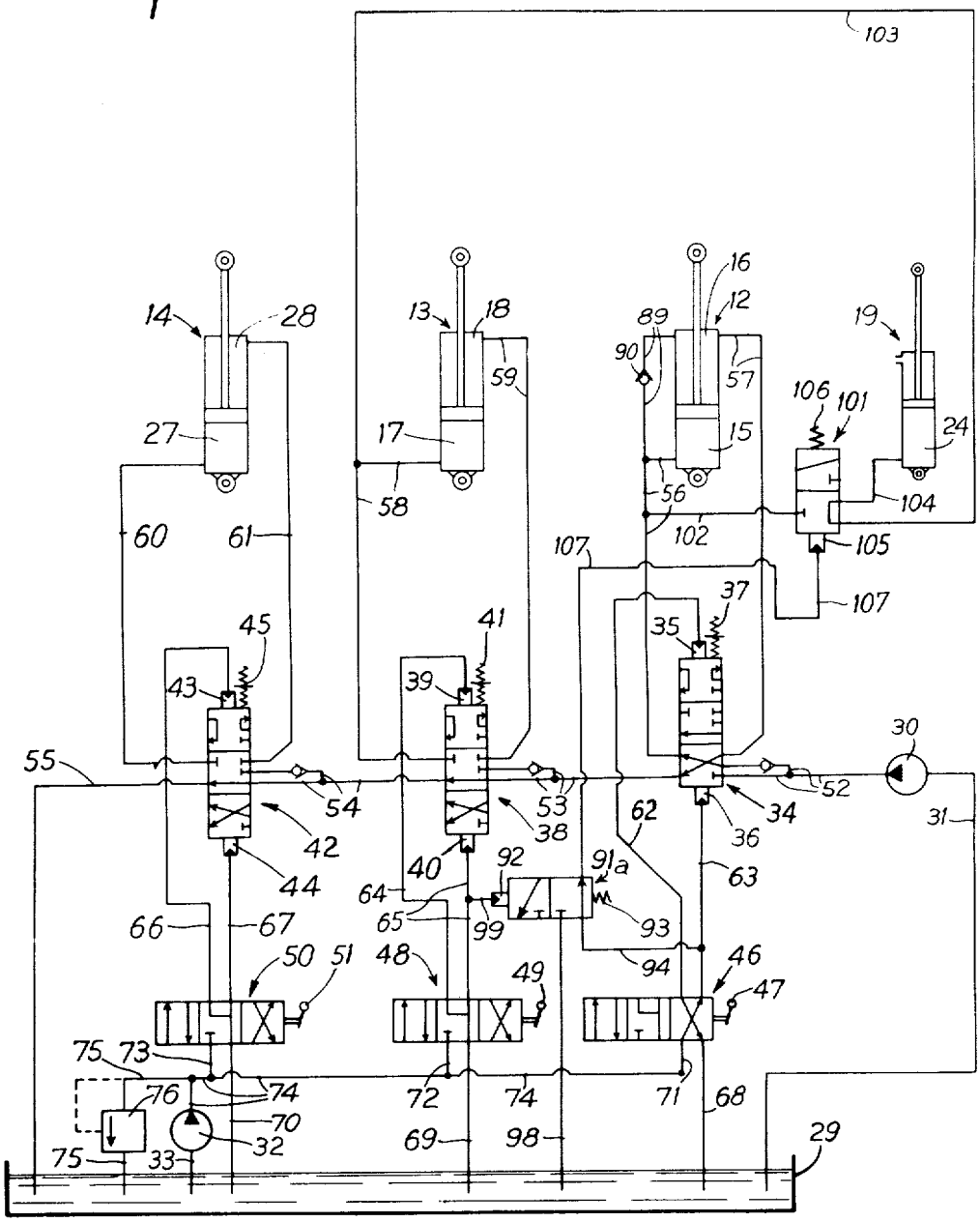
FIGS. 5 and 6 show the diagram of the hydraulic circuit of a variant embodiment according to the invention, in two distinct configurations of functioning, of the circuit diagram of FIGS. 2 to 4.
Figure 6:
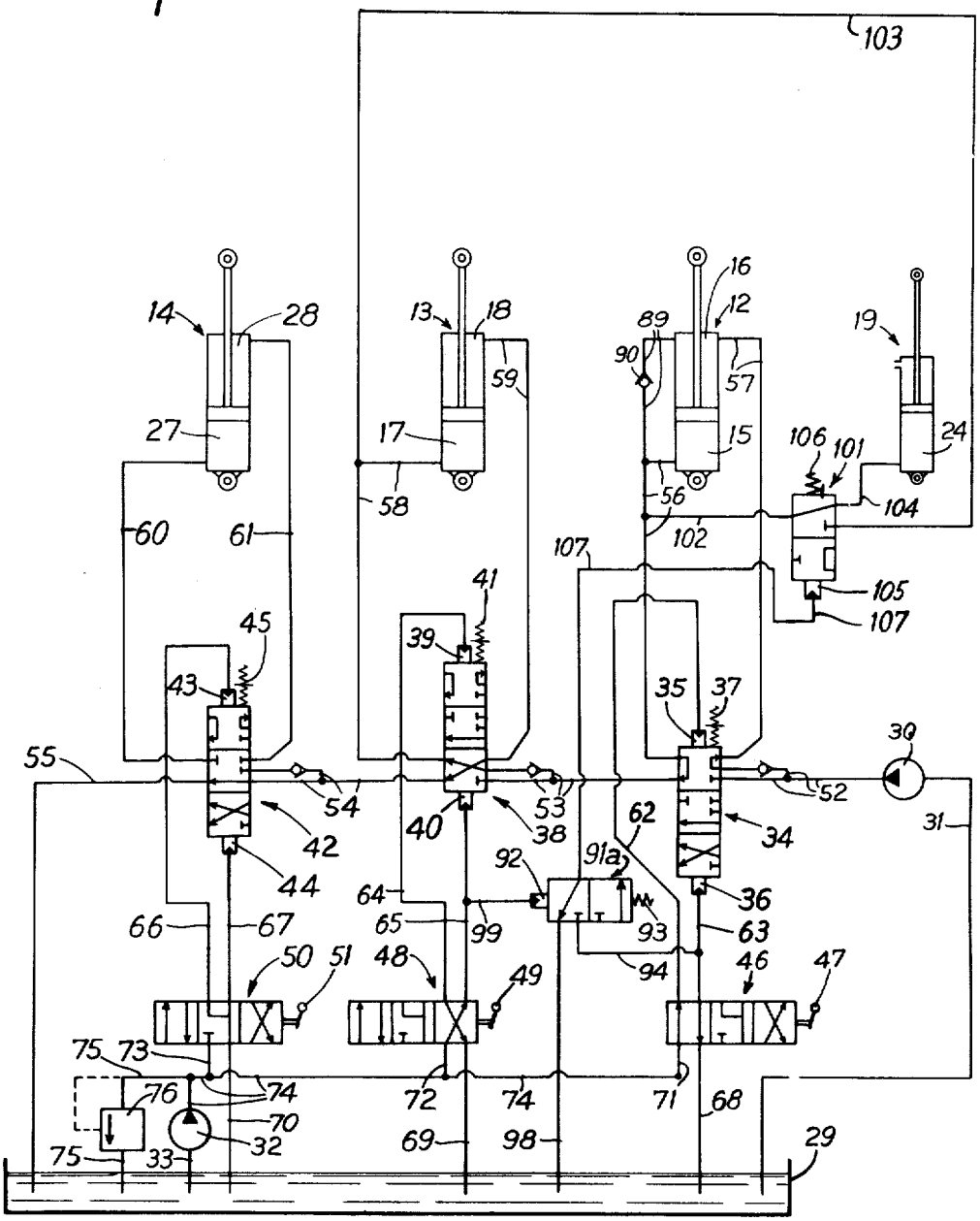

A first variant embodiment of the invention, shown in FIGS. 5 and 6, follows from the following two observations:

the active chamber 24 is either placed in communication with the extension chamber 17 of the balance beam jack 13 via the first cut-off valve 78 and is then isolated by the third cut-off valve 86 from the raising chamber 15 of the boom jack 12 (FIG. 2), or, on the contrary, placed in communication with this raising chamber 15 via this third cut-off valve 86 and is then isolated from the extension chamber 17 by said first cut-off valve 78 (FIGS. 3 and 4);

the function of the second cut-off valve 82 is, in the configuration of FIG. 2, to make it possible to add a complement of feeding fluid in the extension chamber 18 of the balance beam jack 13.

The concomitance of the adjustments of positions of the first and third cut-off valves 78 and 86 may be obtained by adoption of coupled controls of these valves (conduits 96 and 97 and springs 80 and 88), but may also be obtained by replacing these two valves by a three-way main cut-off valve 101. Modifying, therefore, the preceding diagrams, solely in the following manner, by elimination of the first, second and third cut-off valves 78, 82 and 86 respectively, and, of course, of conduits 77, 81, 85 and 95, 96 and 97 corresponding thereto, and by adoption of such a novel main cut-off valve 101, this main cut-off valve 101 is connected:

by conduit 102 to conduit 56, by conduit 103 to conduit 58, and by conduit 104 to the active chamber 24.

This main two-way cut-off valve 101 is provided with a jack 105 for adjusting its position, placing it in its first position when it is supplied with fluid (FIG. 5) and with a return spring 106 which returns it, on the contrary, into its second position when the jack 105 is not supplied (FIG. 6). The preceding control valve 91 is itself replaced by a control valve 91*a* of which the connections and functions are strictly identical to those of the control valve 91, except for the replacement of the preceding conduit 95 by a conduit 107 which connects the control valve 91*a* to the jack 105.

The two positions of the main cut-off valve 101 correspond as follows:

the first position to the communication of conduits 103 and 104, to the obturation of conduit 102 and to the first position of control valve 91*a* (FIG. 5), and the second position to the communication of conduits 102 and 104, to the obturation of conduit 103 and to the second position of the control valve 91*a* (FIG. 6).

Replacement of the cut-off valves 78 and 86 by the single main cut-off valve 101 leads to simpler production which is often sought and, in addition, changes nothing in the general functioning set forth with regard to FIGS. 2 to 4, except the elimination of the cut-off valve 82.

The elimination of this second cut-off valve 82 mentioned in the definition of the variant embodiment of FIGS. 5 and 6, within the spirit of the second preliminary remark, means that the feed of the return chamber 18 by the fluid expelled from the lowering chamber 16 of the boom jack 12 is no longer ensured. In the example of FIGS. 5 and 6, this feed is therefore not provided; as a variant, it could of course be provided and in particular be obtained by double feed valves with which the fluid control valves are generally provided.

Figure 7:
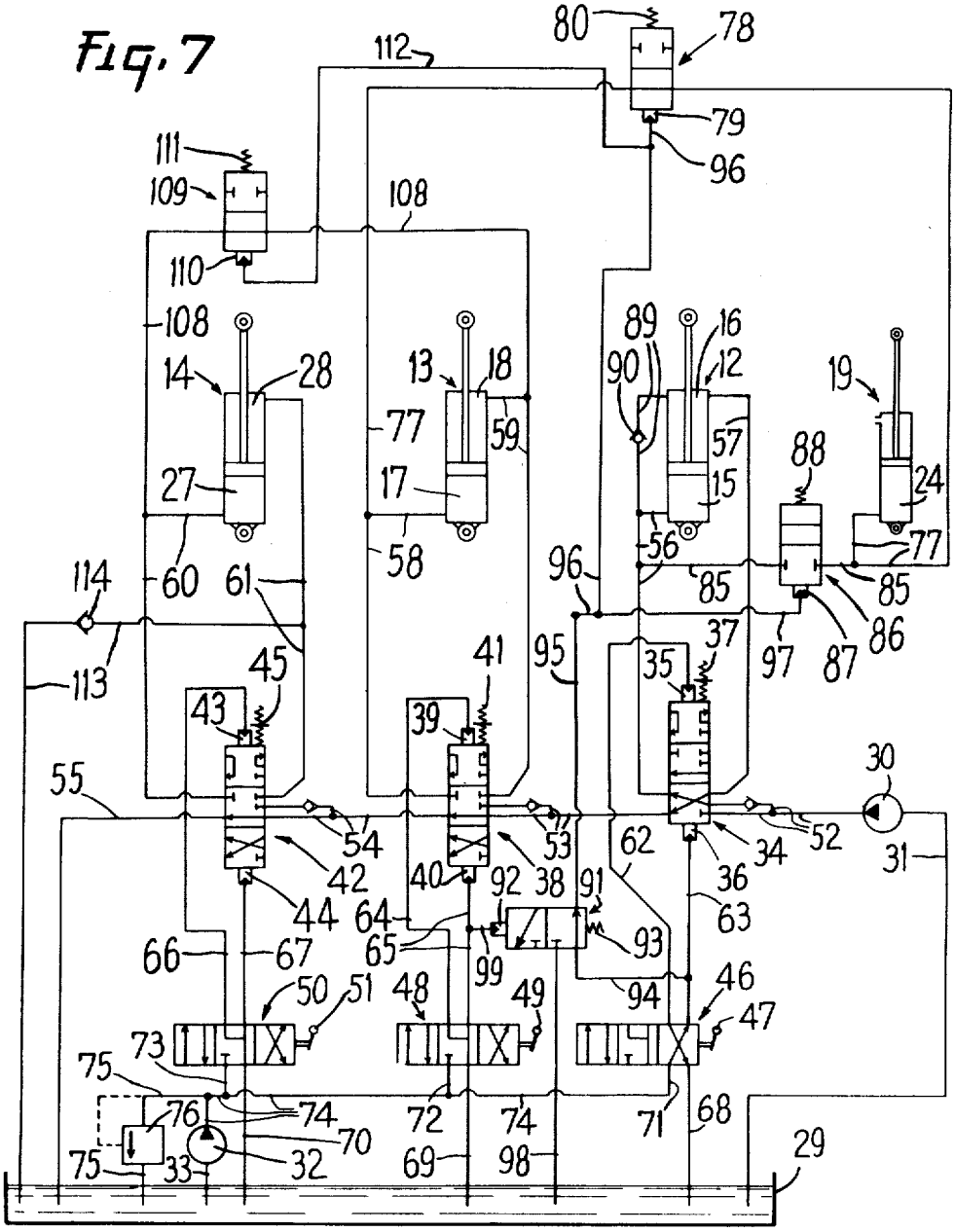
FIG. 7 shows the diagram of the hydraulic circuit of another variant embodiment according to the invention of the circuit diagram of FIG. 2.

A second variant embodiment, shown in FIG. 7, takes the constitution of the diagram of FIG. 2, except for the second cut-off valve 82 and the conduit 81 which do not belong to this second variant. Furthermore, the following complements and adaptations have been adopted:

a conduit 108 connects the conduit 60 to conduit 59, a fourth cut-off valve 109, with two positions, is disposed in the conduit 108 and is provided with a jack 110 for adjusting its position, placing it in its first position when it is supplied with fluid, and with a return spring 111 which, on the contrary, returns it into second position when the jack 110 is not supplied, the conduit 95 is connected to the control valve 91, the conduit 96 which connects the jack 79 to the conduit 95, constitutes an extension of this conduit 95, a conduit 112 connects the jack 110 to the conduit 96, a conduit 113 connects the conduit 61 to the tank 29, and a non-return valve 114, disposed in this conduit 113, allows passage of the fluid solely from the tank towards conduit 61.

The two positions of the cut-off valve 109 correspond as follows: the first position to the maintaining of the continuity of the conduit 108 and the second position to the obturation of this conduit 108.

The functioning of the circuit of FIG. 7 must be more particularly specified as far as its novel part corresponding to the presence of the fourth cut-off valve 109 is concerned.

In the configuration shown in FIG. 7, the control valves 34 and 46 are placed in their third position, corresponding to the supply of pressurised fluid delivered by the main pump 30 of the raising chamber 15 of the boom jack 12. The control valves 38 and 48 are placed in their second position, so that the fluid of lowering chamber 16 can return to the tank via conduit 57, control valve 34, conduit 53, control valve 38, conduit 54, control valve 42 and conduit 55. Furthermore, the conduit 65 communicating with the tank 29 via the control valve 48 and the conduit 69, the spring 93 has placed control valve 91 in its first position. The pressurized fluid contained in the conduit 63 reaches the jacks 79, 87 and 110, via conduits 95, 95, 96, 97 and 112 and the control valve 91, and places the cut-off valves 78, 86 and 109 in their respective first position. The cut-off valves 78 and 109 place in communication:

the cut-off valve 78, the active chamber 24 of the secondary jack 19 and extension chamber 17 of the balance beam jack 13, and the cut-off valve 109, the filling chamber 27 of the bucket jack 14 and return chamber 18 of the balance beam jack 13.

Thus, whilst the supply of pressurised fluid of the raising chamber 15 provokes the rise of the boom 6, the extension of the secondary jack 19 provokes the suction in the active chamber 24 of the fluid contained in the extension chamber 17 and consequently the return of the balance beam 8 towards the boom 6. Furthermore, the retraction of the balance beam jack 13, consecutive to the suction of the fluid contained in its extension chamber 17, provokes the suction in the return chamber 18 of the fluid contained in the filling chamber 27 of the bucket jack 14. The orientation of the bucket 10 with respect to the balance beam 8 is consequently modified and it is observed that the modifications in orientation of the boom 6, the balance beam 8 and of the bucket 10 with respect to one another, result in the maintaining of a substantially constant orientation, with respect to the ground 3, of the bucket 10 during its lift, which is often a desired advantage. The supply of fluid of the emptying chamber 28 of the bucket jack 14 is effected, during this phase of operation, by a known feeding means such as constituted in the example shown by the conduit 113 and the non-return valve 114.

It should further be noted that the device for correcting the orientation of the bucket 10 with respect to the ground comprising the cut-off valve 109 and the conduit 108, also receives application in the embodiment of FIGS. 5 and 6, since, in this embodiment, there is a cut-off valve 101 which acts in particular as a first cut-off valve similar to the valve 78 of the embodiment of FIGS. 2, 3 and 4 and of that of FIG. 7.

The invention is not limited to the embodiment shown but covers, on the contrary, all variants which may be made thereto without departing from the scope thereof.

What is claimed is:

1. In an earthworking machine of the loader type, constituted by:

a frame, a boom mounted to pivot with respect to the frame about a first axis, a balance beam mounted to pivot with respect to the boom about a second axis, the first and second axes being parallel to each other, a material loading bucket coupled to the balance beam, preferably by means of a third pivot axis and a bucket jack, a double-acting, boom jack, coupled between the frame and the boom and comprising a boom raising chamber and a boom lowering chamber, double-acting, balance beam jack, coupled between the boom and the balance beam and comprising a chamber for extension of the balance beam with respect to the boom and a chamber for return of the balance beam with respect to this boom, a circuit for supplying said jacks with pressurised fluid comprising:

at least one source of pressurised fluid, and at least two three-way control valves disposed as follows: a boom control valve between the boom jack and a source of fluid under pressure and a balance beam control valve between the balance beam jack and a source of fluid under pressure, each capable of selectively placing one of the chambers of the corresponding jack in communication with the source of fluid under pressure, with an exhaust or of isolating this chamber from said source of fluid under pressure and, correlatively, of placing the other chamber in communication with the exhaust, with the source of pressurised fluid, or of isolating this other chamber from said source of pressurised fluid, and a secondary jack coupled between the frame and the boom and comprising at least one active chamber, a first conduit connects this active chamber of the secondary jack to the chamber for extension of the balance beam jack, a first cut-off valve with at least two positions being disposed in this first conduit, establishing, in its first position, the communication of the two sections of the first conduit connected thereto, but, in its second position, isolating these two sections.

2. The machine of claim 1, wherein a second conduit connects the lowering chamber of the boom jack and the return chamber of the balance beam jack, whilst a second cut-off valve with at least two positions is disposed in this second conduit, establishing, in its first position, the communication of the two sections of the second conduit which are connected thereto, but, in its second position, isolating these two sections, and a synchronization device ensures the concomitance of the positioning of the first and second cut-off valves in their respective first position and in their respective second position.

3. The machine of claim 1, wherein a third conduit connects the raising chamber of the boom jack and the active chamber of the secondary jack, whilst a third cut-off valve with at least two positions is disposed in this third conduit, isolating, in its first position, the two sections of the third conduit connected thereto, but establishing, in its second position, communication of these two sections, and the synchronization device further ensures the concomitance of the positioning of the first and third cut-off valves in their respective first position and in their respective second position.

4. The machine of claim 3, wherein the first and third cut-off valves constitute a single main cut-off valve, whilst the sections of the first conduit and of the third conduit connected to the active chamber of the secondary jack constitute a single, connecting conduit, connecting said active chamber to the said main cut-off valve, this main cut-off valve having two positions and, in its first position, establishing communication of the section of the first conduit connected to the extension chamber of the balance beam jack and of the connecting conduit, and obturating the section of the third conduit connected to the raising chamber of the boom jack, establishing, on the contrary, in its second position, communication of the section of the third conduit connected to said raising chamber and of the connecting conduit, then obturating said section of the first conduit connected to the extension chamber.

5. The machine of claim 4, wherein the circuit for supplying the boom and balance beam jacks is of the series-supply circuit type, and in particular comprises a single source of fluid under pressure connected to the boom control valve, a fourth conduit which connects this boom control valve to the raising chamber of the boom jack, a fifth conduit which connects the boom control valve to the balance beam control valve and a sixth conduit which connects the balance beam control valve to the extension chamber of the balance beam jack, and the synchronization device ensures concomitance of the positioning of the balance beam control valve in the position connecting the fifth conduit, which then ensures exhaust of the raising chamber of the boom jack, to the sixth conduit which ensures the communication of the extension chamber of the balance beam jack with a source of fluid under pressure and of the main cut-off valve in its second position.

6. The machine of claim 3, wherein the circuit for supplying the boom and balance beam jacks is of the series-supply circuit type, and in particular comprises a single source of fluid under pressure connected to the boom control valve, a fourth conduit which connects this boom control valve to the raising chamber of the boom jack, a fifth conduit which connects the boom control valve to the balance beam control valve and a sixth conduit which connects the balance beam control valve to the extension chamber of the balance beam jack, and the synchronisation device ensures concomitance of the positioning of the balance beam control valve in the position connecting the fifth conduit which then ensures exhaust of the raising chamber of the boom jack, to the sixth conduit which ensures the communication of the extension chamber of the balance beam jack with a source of fluid under pressure and of the third cut-off valve in its second position.

7. The machine of claim 1, wherein a seventh conduit connects the lowering and raising chambers of the boom jack, whilst a non-return valve is disposed in this seventh conduit and allows passage of the fluid solely from the lowering chamber towards the raising chamber.

8. The machine of claim 1, wherein a bucket jack is coupled between the balance beam and the bucket, said jack being of the double-acting type and comprising a bucket filling chamber and a bucket emptying chamber, whilst an eighth conduit connects the filling chamber of the bucket jack to the return chamber of the balance beam jack, a fourth cut-off valve having at least two positions being disposed in this eighth conduit, establishing, in its first position, communication of the two sections of the eighth conduit which are connected thereto and on the contrary isolating these two sections, in its second position.

9. The machine of claim 8, wherein it comprises a synchronization device which ensures concomitance of the positioning of the first and fourth cut-off valves in their respective first position and in their respective second position.

10. The machine of claim 9, wherein the supply circuit of the boom jack comprises in particular a source of fluid under pressure connected to the boom control valve and a fourth conduit which connects this boom control valve to the raising chamber of the boom jack, whilst said synchronization device ensures the concomitance of the positioning of the boom control valve in its position in which the fourth conduit is connected to the source of fluid under pressure, and of the positioning of the fourth cut-off valve in its first position.

11. The machine of claim 1, wherein a third conduits connects the raising chamber of the boom jack and the active chamber of the secondary jack, whilst a third cut-off valve with at least two positions is disposed in this third conduit, isolating, in its first position, the two sections of the third conduit which are connected thereto, and establishing, on the contrary, in its second position, the communication of these two sections, and the synchronization device further ensures concomitance of the positioning of the first and third cut-off valves in their respective first position and in their respective second position, and a bucket jack is coupled between the balance beam and the bucket and, being of the double-acting type, comprises a bucket filling chamber and a bucket emptying chamber, whilst an eighth conduit connects the filling chamber of the bucket jack to the return chamber of the balance beam jack, a fourth cut-off valve with at least two positions being disposed in this eighth conduit, establishing, in its first position, communication of the two sections of the eighth conduit which are connected thereto, and, in its second position, isolating these two sections.

12. The machine of claim 11, wherein it comprises a synchronisation device which ensures the concomitance of the positioning of the first and fourth cut-off valves in their respective first position and in their respective second position.

13. The machine of claim 12, wherein the supply circuit of the boom jack comprises in particular a source of fluid under pressure connected to the boom control valve and a fourth conduit which connects this boom control valve to the raising chamber of the boom jack, whilst said synchronization device ensures the concomitance of the positioning of the boom control valve in its position in which the fourth conduit is connected to the source of fluid under pressure and of the positioning of the fourth cut-off valve in its first position.

* * * * *